US007969236B1

(12) United States Patent
Hyde et al.

(10) Patent No.: US 7,969,236 B1
(45) Date of Patent: Jun. 28, 2011

(54) REFERENCE CURRENT GENERATOR WITH LOW TEMPERATURE COEFFICIENT DEPENDENCE

(75) Inventors: John D. Hyde, Corvallis, OR (US); Christopher J. Diorio, Shoreline, WA (US)

(73) Assignee: Impinj, Inc., Seattle, WA (US)

( * ) Notice: Subject to any disclaimer, the term of this patent is extended or adjusted under 35 U.S.C. 154(b) by 286 days.

(21) Appl. No.: 12/471,362

(22) Filed: May 23, 2009

Related U.S. Application Data

(63) Continuation-in-part of application No. 11/981,396, filed on Oct. 30, 2007, now abandoned.

(51) Int. Cl.
*G05F 1/10* (2006.01)

(52) U.S. Cl. ..... 327/538; 327/541; 327/543

(58) Field of Classification Search ..... 327/538, 327/540, 541, 543; 323/312, 315, 316
See application file for complete search history.

(56) References Cited

U.S. PATENT DOCUMENTS

| | | | | |
|---|---|---|---|---|
| 5,910,749 | A * | 6/1999 | Kimura | 327/541 |
| 6,724,243 | B2 * | 4/2004 | La Rosa | 327/543 |
| 2007/0057717 | A1 * | 3/2007 | Choi | 327/543 |

* cited by examiner

*Primary Examiner* — Long Nguyen
(74) *Attorney, Agent, or Firm* — Turk IP Law, LLC

(57) ABSTRACT

Embodiments of the invention describe a core circuit for a reference current generator circuit that biases a first transistor to source a first current and a second transistor parallel to the first transistor, biased to source a second current controlled by the first current. A third transistor is coupled parallel to the second transistor and sources a third current controlled by the first current. The third transistor has a different threshold voltage than a threshold voltage of the second transistor. A resistive component coupled to conduct the second current has a resistive voltage that is substantially equal to a voltage differential between the first transistor and the second transistor. The conducting current through the resistive component is substantially independent of temperature variations.

17 Claims, 10 Drawing Sheets

CORE CIRCUIT COUPLED TO BIAS CIRCUIT WITH AMPLIFIER

PRIOR ART REFERENCE CURRENT GENERATOR CIRCUIT

*VOLTAGE RESPONSES TO TEMPERATURE CHANGE IN PRIOR ART REFERENCE CURRENT GENERATOR*

REFERENCE CURRENT GENERATOR CIRCUIT

CURRENT RESPONSES TO TEMPERATURE CHANGE IN CORE CIRCUIT

*VOLTAGE RESPONSES TO TEMPERATURE CHANGE IN CORE CIRCUIT*

CORE CIRCUIT COUPLED TO BIAS CIRCUIT WITH AMPLIFIER

CORE CIRCUIT COUPLED TO BIAS CIRCUIT WITH TRANSCONDUCTANCE AMPLIFIER

REFERENCE CURRENT GENERATOR WITH LOW TEMPERATURE COEFFICIENT DEPENDENCE

RELATED PATENT APPLICATIONS

This utility patent application is a continuation-in-part (CIP) of U.S. patent application Ser. No. 11/981,396, filed Oct. 30, 2007 now abandoned. The benefit of the earlier filing date of the parent application is hereby claimed under 35 U.S.C. §120.

BACKGROUND

A number of integrated circuits require a current reference for biasing various operations. For example, Radio Frequency IDentification (RFID) systems may be integrated circuits, and typically include RFID tags and RFID readers. RFID readers are also known as RFID reader/writers or RFID interrogators. RFID systems can be used in many ways for locating and identifying objects to which the tags are attached. In earlier RFID tags, the power management section included an energy storage device, such as a battery. RFID tags with an energy storage device are known as active tags. Advances in semiconductor technology have miniaturized the electronics so much that an RFID tag can be powered solely by the RF signal it receives. Such RFID tags do not include an energy storage device, and are called passive tags.

RFID systems are particularly useful in product-related and service-related industries for tracking large numbers of objects being processed, inventoried, or handled. In such cases, an RFID tag is usually attached to an individual item, or to its package.

In principle, RFID techniques entail using an RFID reader to interrogate one or more RFID tags. The reader transmitting a Radio Frequency (RF) wave performs the interrogation. A tag that senses the interrogating RF wave responds by transmitting back another RF wave. The tag generates the transmitted back RF wave either originally, or by reflecting back a portion of the interrogating RF wave in a process known as backscatter. Backscatter may take place in a number of ways.

The reflected-back RF wave may further encode data stored internally in the tag, such as a number. The response is demodulated and decoded by the reader, which thereby identifies, counts, or otherwise interacts with the associated item. The decoded data can denote a serial number, a price, a date, a destination, other attribute(s), any combination of attributes, and so on.

RFID tags may include a number of circuits, analog or digital, that are biased by a current reference. Reference current generators in integrated circuits, such as the RFID system, may be designed a number of ways known in the art. Prior art reference current generators typically generate currents that are proportional to absolute temperature ("PTAT"), and therefore currents that increase as temperature increases.

FIG. 1 is a diagram of a prior art reference current generator circuit 123 that includes a bias circuit 110 for providing drain currents to a pair of NMOS transistors 114 in a current mirror configuration. Reference currents are generated by the reference current generator circuit 123 by coupling a P-type mirror circuit 121P and an N-type mirror circuit 121N to each of the respective drains of the transistors 114 at nodes 113 and 117.

More specifically, the bias circuit 110 includes a pair of PMOS transistors 112, sourced by a voltage supply VDD, whose gates are coupled to each other and to the drain of one of the transistors 112 at node 113. Each of the drains of the transistors 112 are coupled to the drains of the transistors 114, whose gates are coupled to each other and to the drain of one of the transistors 114 at the node 117. Therefore, the drain current through the node 117 determines the gate-to-source voltage for both devices. The sources of the transistors 114 are coupled to ground, one of which is coupled to ground through a resistor 116. The transistor 114 coupled to node 113 is designed to have a smaller gate-to-source voltage than the transistor 114 coupled to node 117. The voltage differential between the gate-to-source voltages of the transistors 114 is thus the voltage across the resistor 116. The transistors 114 are similar devices and typically designed to have the same threshold voltage $V_{T1}$. Because the transistors 114 have the same threshold voltage, the devices differ in size or current density to create the voltage differential necessary to provide the voltage drop across the resistor 116. The resulting resistor current through the resistor 116 is mirrored by the bias circuit 110 to determine the drain currents through the nodes 113, 117.

As current passes through the transistors 114, voltages $V_{PGATE}$ and $V_{NGATE}$ at nodes 113, 117 may respectively be used to drive one or more mirror circuits 121P, 121N for generating the reference currents. For example, a PMOS transistor 132 in the mirror circuit 121P may be biased by the $V_{NGATE}$ voltage at node 113 to generate a reference current $I_{PREF}$ sourced from VDD. Similarly, an NMOS transistor 134 in the mirror circuit 121N may be biased by the $V_{NGATE}$ voltage to generate another reference current $I_{NREF}$. The $I_{PREF}$ and $I_{NREF}$ currents may be used to bias other circuitry, for example, components in the RFID system.

A problem with the prior art reference current generator circuit 123, however, is that the generated reference current increases as temperature increases due to the currents being directly proportional to temperature. As a result, the current references generated by the prior art reference current generator 123 may vary by more than 45% between a wide range of temperatures −40° C. to +65° C.

FIG. 2 is an illustration of the signal responses of the transistors 114 to temperature changes (ranging between −40° C. to 90° C.) in the prior art reference current generator circuit 123 of FIG. 1. An upper signal diagram 240 shows the gate-to-source voltage of the transistor 114 coupled to node 117 as a function of the drain current. A middle signal diagram 250 shows the gate-to-source voltage of the transistor 114 coupled to node 113 as a function of the drain current. In both cases, an increase in temperature causes the gate-to-source voltages of devices such as the transistors 114 to decrease, as is well known in the art. In the upper signal diagram 240, the gate-to-source voltage at a lower temperature −40° C., shown as a signal 245, decreases as the temperature increases to 25° C., shown as a signal 247. The more the temperature increases, the voltage continues to decrease, as shown by the current signal 249 at the higher temperature 90° C. At any given drain current in the middle signal diagram 250, the gate-to-source voltage is less than the gate-to-source voltage at the corresponding drain current in the upper signal diagram 240 so that the difference between the gate-to-source voltage creates the necessary voltage drop across the resistor 116.

Lowering the current density, however, causes a greater gap, as temperature increases, in the spacing between the gate-to-source voltage signals 255-259 of the middle signal diagram 250, as compared to the signals 245, 247, 249 of the upper signal diagram 240. Consequently, the change in voltage difference between the signal 255 at the temperature −40° C. and the signal 257 at the temperature 25° C. is greater than the corresponding voltage/temperature signals 245, 247 of the upper signal diagram 240. Therefore, the same difference between transistors 114 to create the voltage differential creates a difference in the temperature variation between the signals of the upper signal diagram 240 and the middle signal diagram 250. Thus the voltage across the resistor 116 is shown in a lower signal diagram 260 to have PTAT characteristics, where the voltage represented by signals 265, 267, 269 increase as the temperature increases from −40° C. to 25° C. and 90° C., respectively.

Therefore, a consequence of creating the voltage drop across the resistor 116 in the prior art reference current generator circuit 123 is the undesirable increase in the resistor voltage as temperature increases. As a result, the prior art reference current generator circuit 123 provides reference currents that are temperature dependent. The high current variation of the reference currents (by 45%) increases power consumption and degrades performance. For example, sensitivity is a critical parameter particularly in RFID systems, since passive tags rely on power from readers antennas to operate. Any undesirable variation in the reference current due to temperature, and thus an increase in power consumption, limits the reliability and performance of RFID tags.

There is therefore a need for a reference current generator circuit that reduces the temperature dependent variation of the reference current such that the reference current maintains a substantially constant current over a wide range of temperatures.

BRIEF SUMMARY

Embodiments described in the present description gives instances of reference current generator circuits, systems that include reference current generator devices, and methods, the use of which may help overcome these problems and limitations of the prior art.

In one optional embodiment, a core circuit for a reference current generator circuit includes an input node that receives a first current and biases a first transistor to source the first current through the first transistor. A second transistor configured parallel to the first transistor, sources a second current that is controlled relative to the first current. The second transistor is coupled in parallel to a third transistor that sources a third current controlled by the first current. The third transistor has a threshold voltage that is different relative to a threshold voltage of the second transistor. The source of the second transistor is coupled to a resistive component that conducts the second current. As a result, a voltage is generated across the resistive component being substantially equal to a voltage differential between the first transistor and the second transistor.

An advantage over the prior art is that the voltage across the resistor, and thus the conducting current, is substantially independent of temperature variations.

These and other features and advantages of this description will become more readily apparent from the following Detailed Description, which proceeds with reference to the drawings, in which:

DETAILED DESCRIPTION

Certain details are set forth below to provide a sufficient understanding of the embodiments of the invention. However, it will be clear to one skilled in the art that the invention may be practiced without these particular details. Moreover, the particular embodiments of the present invention described herein are provided by way of example and should not be used to limit the scope of the invention to these particular embodiments. In other instances, well-known circuits, control signals, timing protocols, and software operations have not been shown in detail in order to avoid unnecessarily obscuring the embodiments of the invention.

Figure 3:
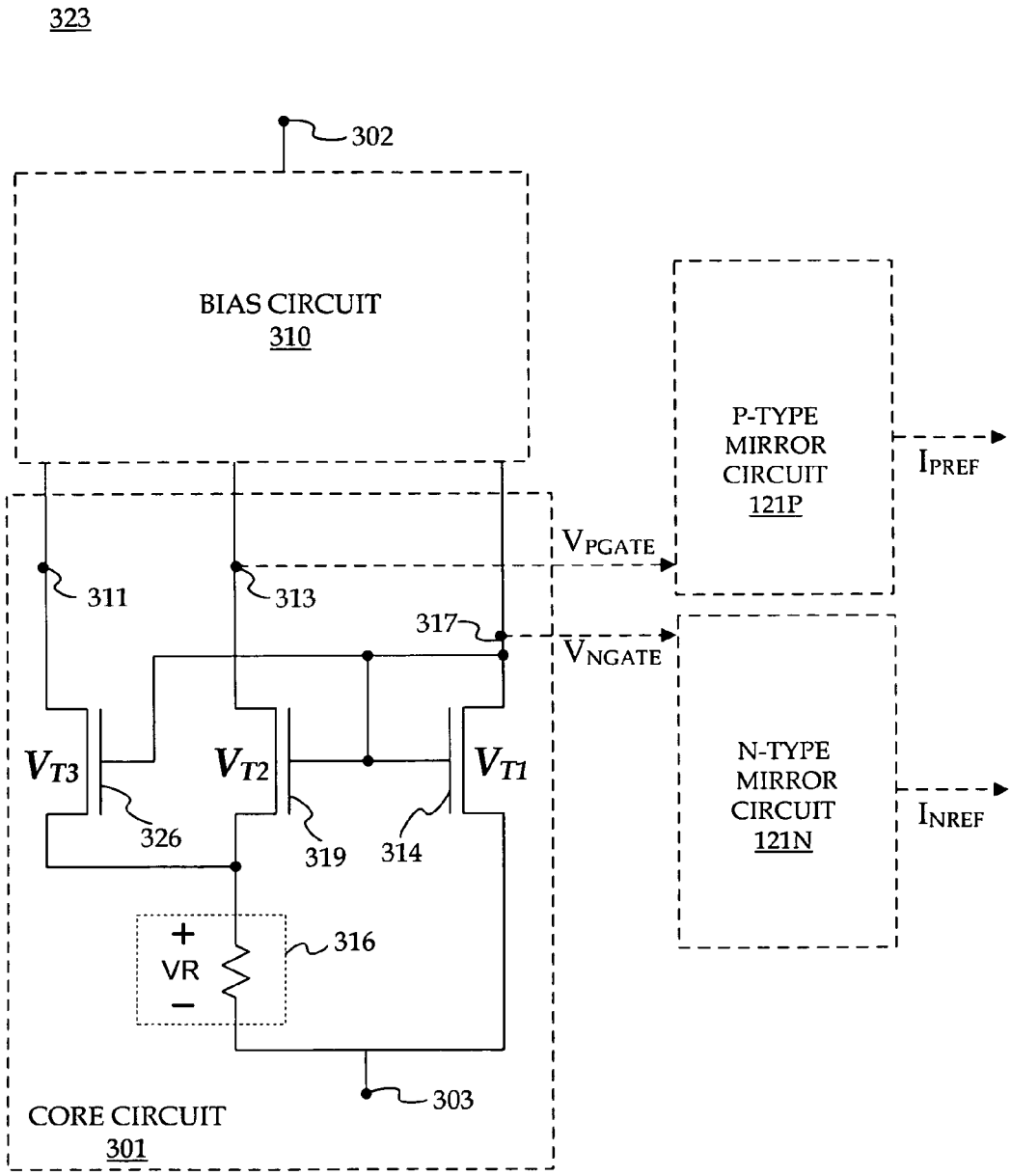
FIG. 3 is a schematic diagram of a reference current generator circuit according to embodiments.

FIG. 3 is a diagram of a reference current generator circuit 323 according to an embodiment of the invention. The reference current generator circuit 323 includes some of the same components as the reference current generator circuit 123 of FIG. 1. In the interest of brevity, those same components have been given the same reference numerals and will not be described again.

The reference current generator circuit 323 includes a core circuit 301 for sourcing a current independent of temperature variations. The core circuit 301 is coupled between two nodes 302, 303. Each of nodes 302, 303 may be coupled to a voltage supply. Slave current circuits, such as the P-type and N-type mirror circuits 121P, 121N may reference the current in the core circuit 301 to generate reference currents that are also independent of temperature variations. The core circuit 301 may be implemented with other circuit components and hardware in any number of ways as will be apparent to a person skilled in the art in view of the present description.

In one such embodiment, the core circuit 301 includes an input node 317 coupled to the drain and gate of a transistor 314 whose source may be coupled to a negative voltage supply at node 303. Thus, the input node 317 may be adapted to receive a current sourced through the transistor 314 towards the node 303. The core circuit 301 includes a second transistor 319 having a gate coupled to the gate of the first transistor 314 in a parallel configuration. A third transistor 326 is coupled to the gates of the first and second transistors 314, 319, and has a source coupled to the source of the second transistor 319. Bias circuit 310 may optionally be included in the core circuit 301 of FIG. 3 to provide one or more currents to the transistors 326, 319, 314 through the nodes 311, 313, 317, respectively. The bias circuit 310 may be one of any number of bias circuits known in the art. Thus, the third transistor 326 is parallel to the second transistor 319. It will be appreciated that the transistors 314, 319, 326 may represent any number, type and combination of devices, one such type of device being NMOS transistors.

The commonly connected sources of the second and third transistors 319, 326 are also coupled to the node 303 through a resistive component 316. The resistive component 316 may be a resistor, a transistor or any component known in the art to drive current towards the node 303. For example, among the resistor-types the resistive component 316 may be polysilicon resistor, a diffused resistor or an n-well resistor. It is desirable to have a resistor size of approximately one million ohms. The size and cost of the core circuit 301 may be minimized by reducing the size of the resistive component 316.

Figure 1:
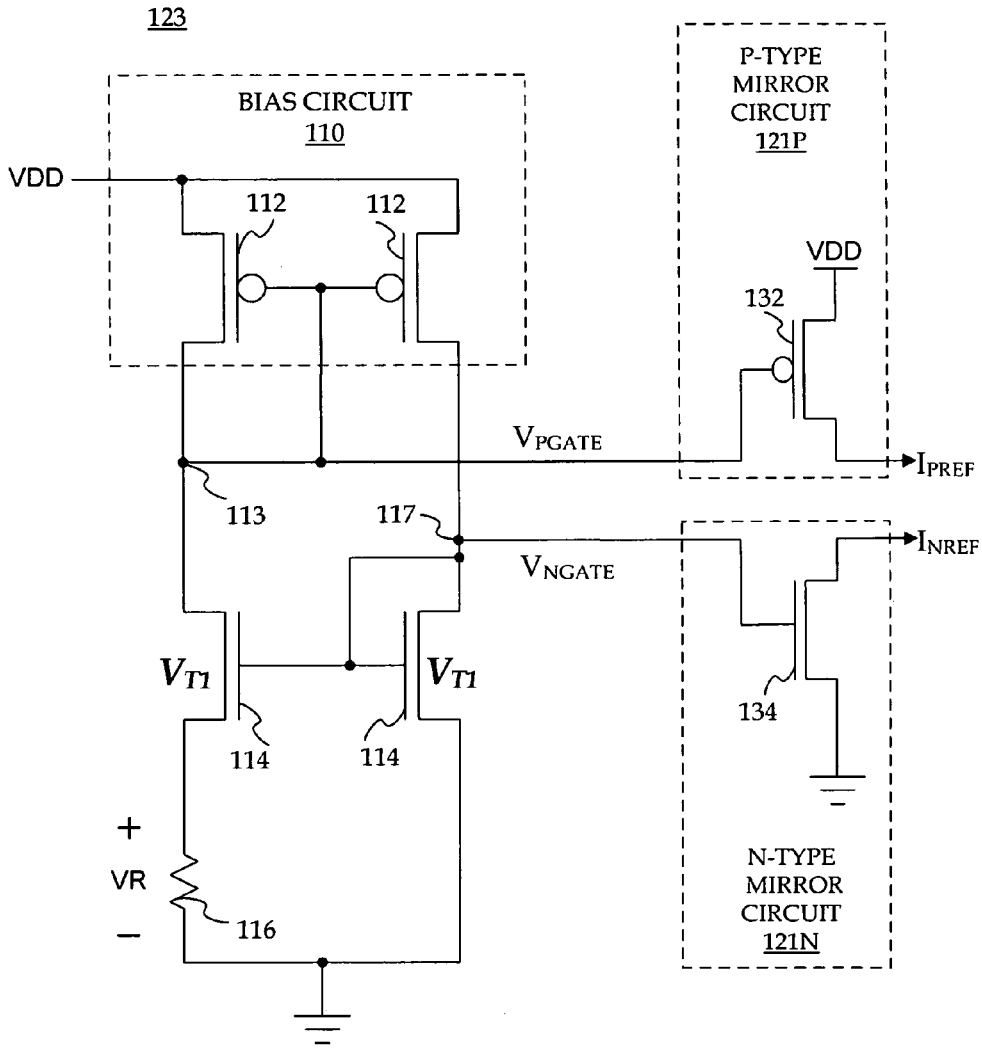
FIG. 1 (PRIOR ART)
FIG. 1 is a schematic diagram of a prior art reference current generator circuit.

Similar to the bias current of the prior art reference current generator 123 of FIG. 1, currents in the core circuit 301 may be driven by generating a voltage drop across the resistive component 316 by a voltage differential between the source of the first transistor 314 and the common source of the second and third transistors 319, 326. The voltage differential in the core circuit 301 may be formed by any number of circuit implementations. One such way is shown in FIG. 3 by the parallel configuration of the second and third transistors 319, 326 relative to the first transistor 314.

The transistors 314, 319 may be similar in that the transistor 314 has a threshold voltage $V_{T1}$ that is substantially the same as a threshold voltage $V_{T2}$ of the transistor 319. However, as in the prior art current reference generator circuit 123, the transistors 314, 319 may be designed to have different current densities such that each device has a different gate-to-source voltage to create the voltage differential. For example, the size of the transistor 319 may be larger, thus having a smaller current density and a lower gate-to-source voltage.

The third transistor 326 in the design of the core circuit 301 is included to counteract the PTAT characteristics of the first and second transistors 314, 319, as previously described with respect to the prior art. The third transistor 326 may be designed to have a different threshold voltage $V_{T3}$ relative to the threshold voltage $V_{T2}$ of the transistor 319, which causes the drain current through the third transistor 326 to have a negative temperature coefficient. The third transistor 326 may be implemented in any way known in the art to respond oppositely to PTAT characteristics of the gate-to-source voltage of the second transistor 319. For example, the $V_{T3}$ of the third transistor 326 may be less than the $V_{T2}$ of the second transistor 319, or the combined threshold voltages of the second and third transistor 319, 326 may be less than the $V_{T1}$ of the first transistor 314. One of the implementations will now be described further.

More specifically, the parallel combination of the second transistor 319 and the third transistor 326 is designed to have a gate-to-source voltage that has substantially the same temperature variation as the gate-to-source voltage of the first transistor 314. This may be achieved by lowering the $V_{T3}$ of the third transistor 326 relative to the second transistor 319. Assuming the threshold voltage $V_{T2}$ of the second transistor 319 is either close to or larger than its gate-to-source voltage, the drain current variation due to temperature in such case is dominated by its threshold voltage, as is known in the art, and thus exhibits a positive temperature coefficient and increases drain current with temperature. By having a lower $V_{T3}$ that is sufficiently less than its gate-to-source voltage, the drain current of the third transistor 326, as known, is dominated by its channel resistance, which results in the drain current of the third transistor 326 decreasing with temperature and having a negative temperature coefficient.

Figure 4:
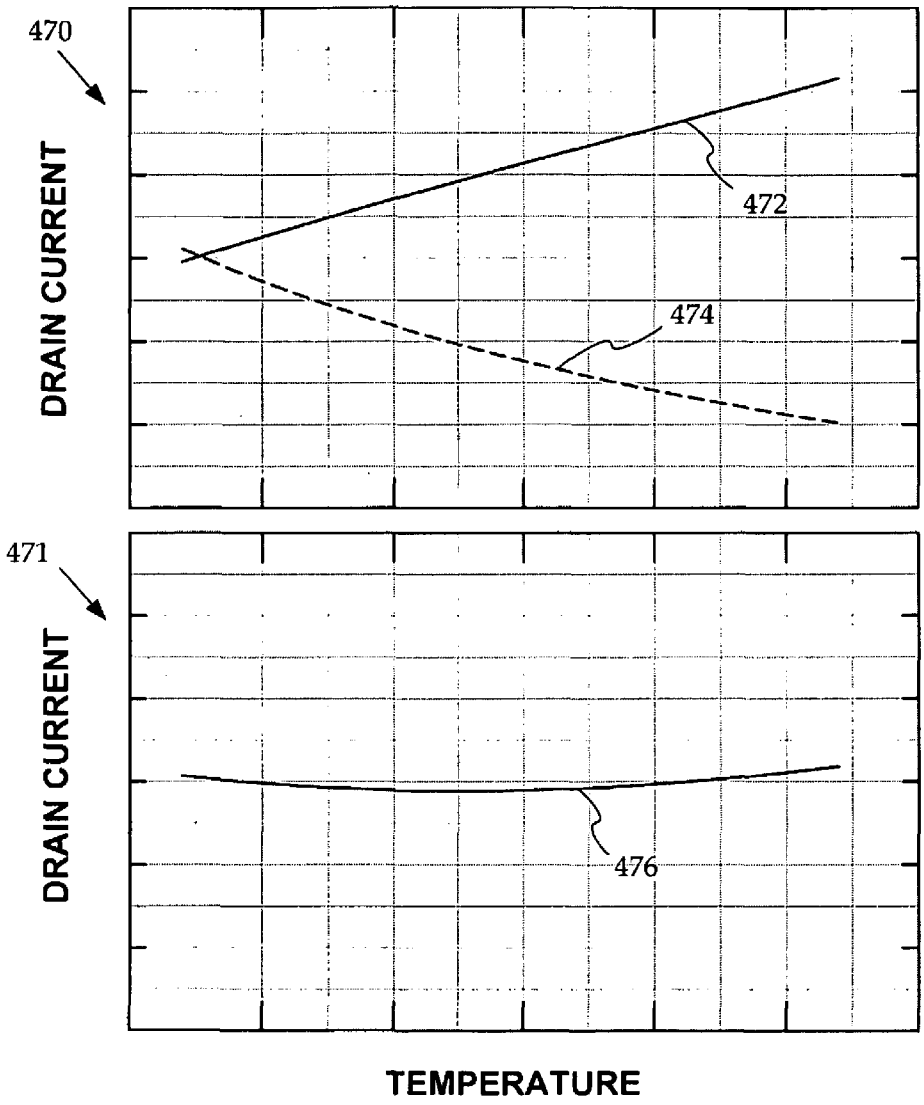
FIG. 4 is two diagrams showing current signal responses to changes in temperature of various components in the core circuit of FIG. 3.

FIG. 4 shows the effects of having a lower $V_{T3}$ on the drain currents of the transistors 319, 326. An upper signal diagram 470 shows signals 472, 474 representing the respective drain currents of the transistors 319, 326 changing as a function of temperature. A lower signal diagram 471 shows the combined effect of summing signals 472, 474 as a function of increasing temperature. The higher $V_{T2}$ of the second transistor 319 results in the drain current increasing with temperature, as shown by the signal 472 of the upper signal diagram 470. The drain current of the third transistor 326 decreases with respect to increasing temperature due to the lower $V_{T3}$, as shown by the signal 474. Thus, the lower signal diagram 471 shows that, by summing the signals 472, 474, a substantially constant total drain current, shown as signal 476, may be maintained across a range of temperatures.

Figure 2:
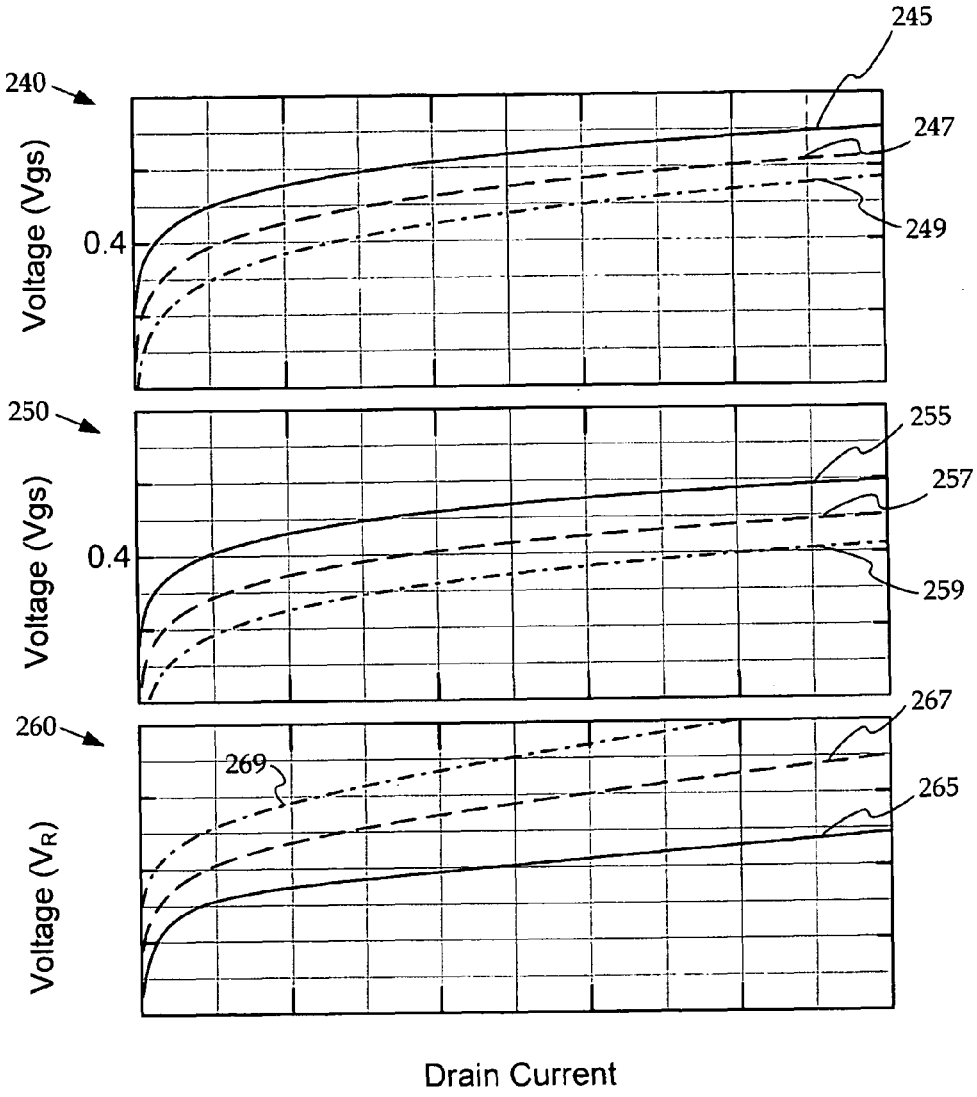
FIG. 2 (PRIOR ART)
FIG. 2 is a diagram showing signal responses to temperature changes of various components in the prior art reference current generator circuit of FIG. 1.
Figure 5:
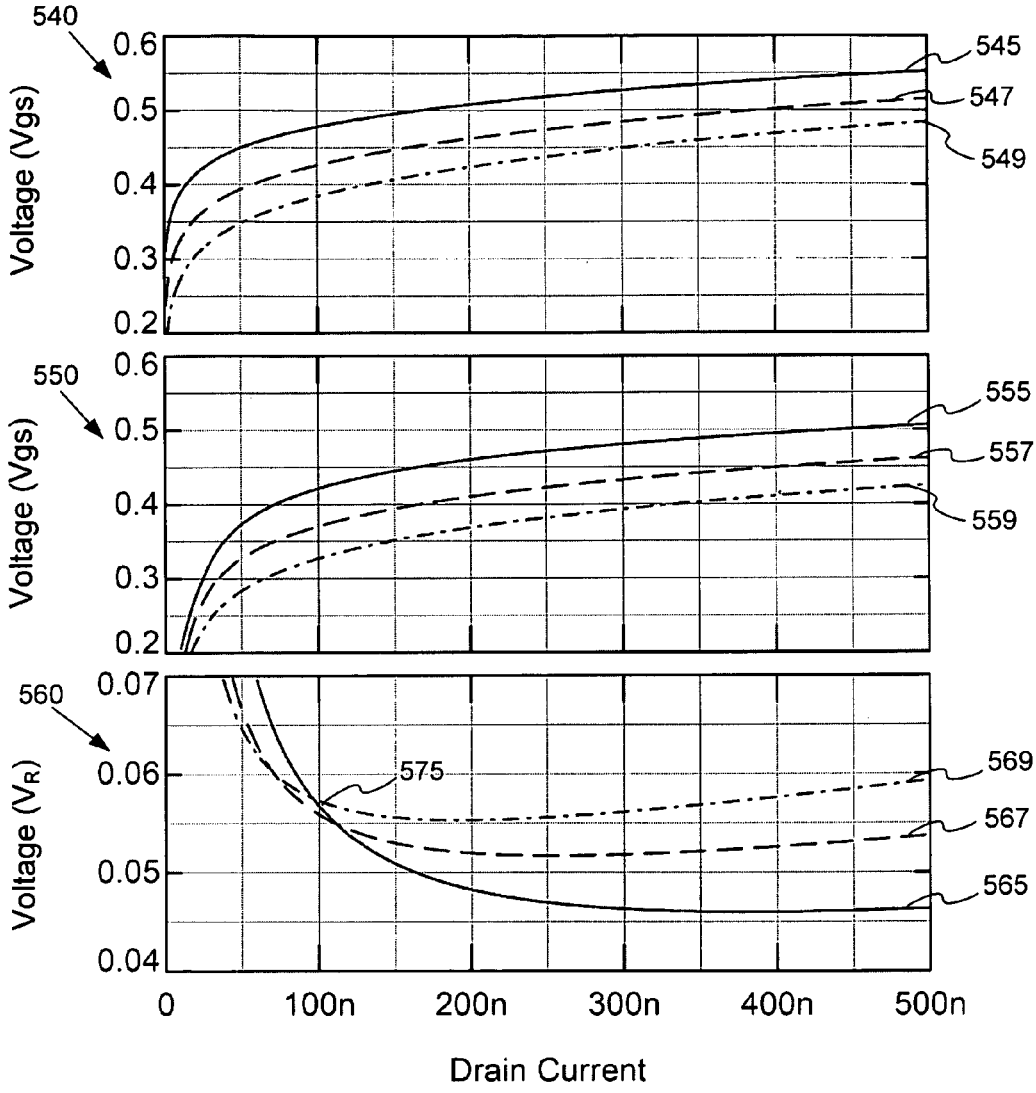
FIG. 5 is three diagrams showing voltage signal responses to temperature changes of various components in the core circuit of FIG. 3.

FIG. 5 includes three signal diagrams that show signal responses to temperature by the transistor 314, the parallel combination of transistors 319, 326, and the resistive component 316 as a result of the lower $V_{T3}$ of the third transistor 326. An upper signal diagram 540 shows the temperature variation of the gate-to-source voltage of the first transistor 314 as temperature increases. A signal 545 represents the gate-to-source voltage of the first transistor 314 as a function of drain current at a low temperature of approximately −40° C. As previously described with respect to FIG. 2, it is known in the art that the gate-to-source voltage decreases as temperature increases, as shown by a signal 547 responding to temperature increasing to approximately 25° C. A signal 549 represents the gate-to-source voltage dropping lower responsive to a higher temperature of approximately 90° C.

A middle signal diagram 550 shows that the gate-to-source voltage transitions of the combined transistors 319, 326 have substantially the same temperature variations, represented by signals 555, 557, 559 respectively, across corresponding temperature changes as the gate-to-source voltage transitions of the first transistor 314 in the upper signal diagram 540. The effect of the third transistor 326 counteracting the temperature variation of the second transistor 319 allows the combined gate-to-source voltage to vary similarly with respect to the first transistor 314, while maintaining a lower gate-to-source voltage, such that the resulting voltage differential is substantially without temperature variation.

A lower signal diagram 560 of FIG. 5 represents the voltage drop across the resistive component 316 over corresponding temperature changes represented by signals 565, 567, 569, respectively. Because the temperature variation is similar for the gate-to-source voltages between the first transistor 314 and the combined second and third transistor 319, 326, the voltage generated across the resistive component 316 is substantially constant over temperature. This is shown in the lower signal diagram 560, by way of example, at approximately 100 nA, where the signals 565, 567, 569 converge at a point 575 representing a constant voltage independent of temperature that ranges between −40° C. to 90° C.

Thus, the core circuit 301 of FIG. 3 allows the drain currents to pass through transistors 314, 319, 326 substantially independent of temperature variation, evidenced by the substantially constant current represented by the signal 476 driven through the resistive component 316. As a result, a relatively constant current is generated through the resistive component 316 due to the gate-to-source voltage differential and the resistive component 316 conducting both of the drain currents from the second and third transistors 319, 326.

An additional advantage of the core circuit 301 is that the substantially constant resistor voltage can be small, and thus a smaller, less expensive resistive component 316 may be used. The size, type, number or combination of components of the resistive component 316 may be changed to alter the current operating point 575 of FIG. 5, as is well-known in the art.

It will be appreciated that the various circuit components and parameters in FIGS. 3-5 are described for the purposes of illustrating an operation of the current reference generator circuit 323. Those ordinarily skilled in the art will obtain sufficient understanding from the description provided herein to make such modifications as needed to practice other embodiments as applied to the current reference generator circuit 323. Those ordinarily skilled in the art will also understand that in FIG. 3 and also the other embodiments that follow, NMOS transistors may be replaced with PMOS, and PMOS transistors may be replaced by NMOS, by changing the supply voltage polarity.

Figure 6:
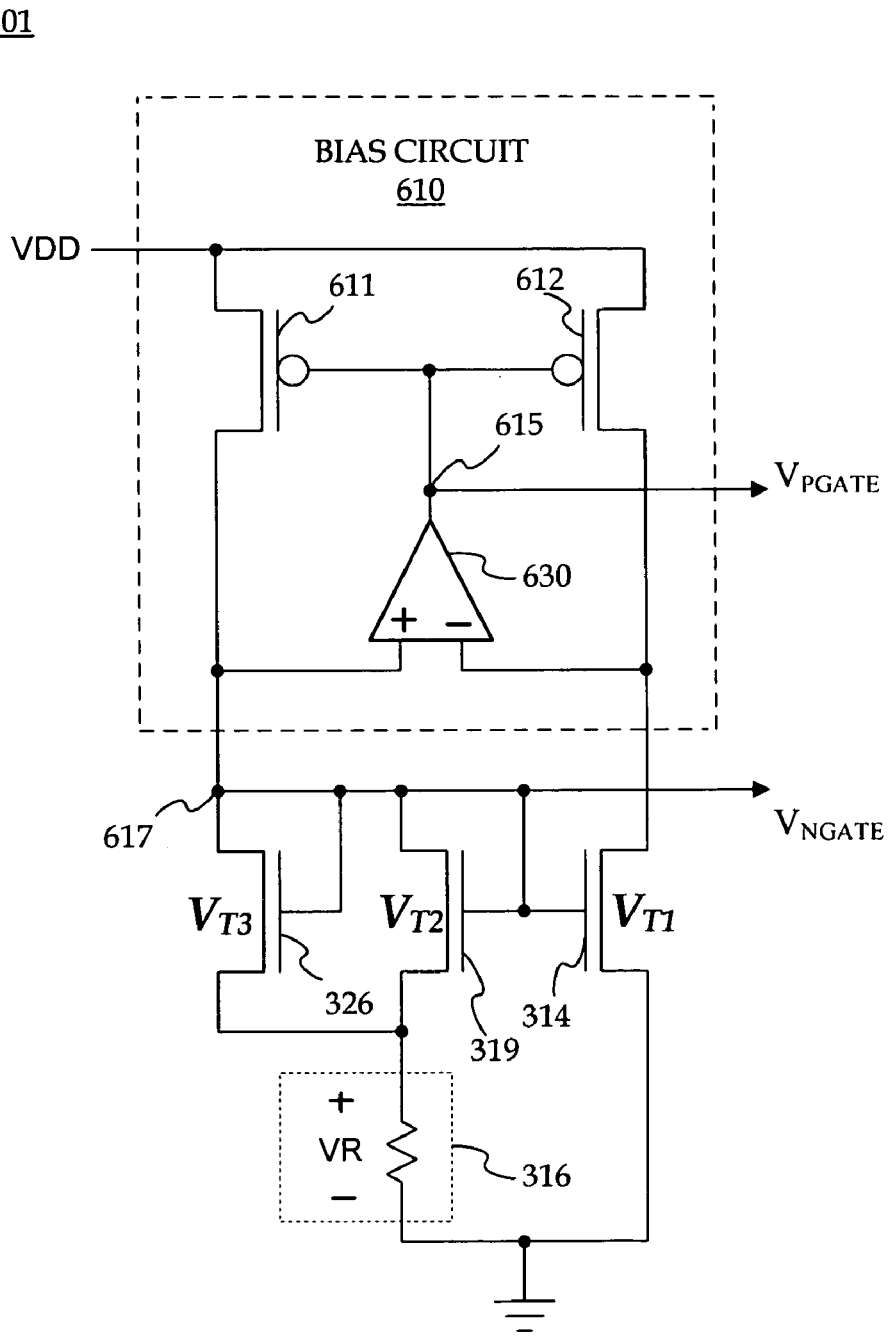
FIG. 6 is a schematic diagram of a core circuit according to one embodiment coupled to a bias circuit.

Referring back to FIG. 3, a bias circuit 310 may optionally be included in the core circuit 301 of FIG. 3 to provide one or more currents to the transistors 314, 319, 326 through the nodes 317, 313, and 311, respectively. The bias circuit 310 may be one of any number of bias circuits known in the art. Some of the embodiments will now be described with reference to FIGS. 6-7. The embodiments in FIGS. 6-7 may share some of the same components as the reference current generator circuit 323 of FIG. 3. These same components are assigned the same reference numerals, and in the interest of brevity, these same components will not be described again.

Figure 9:
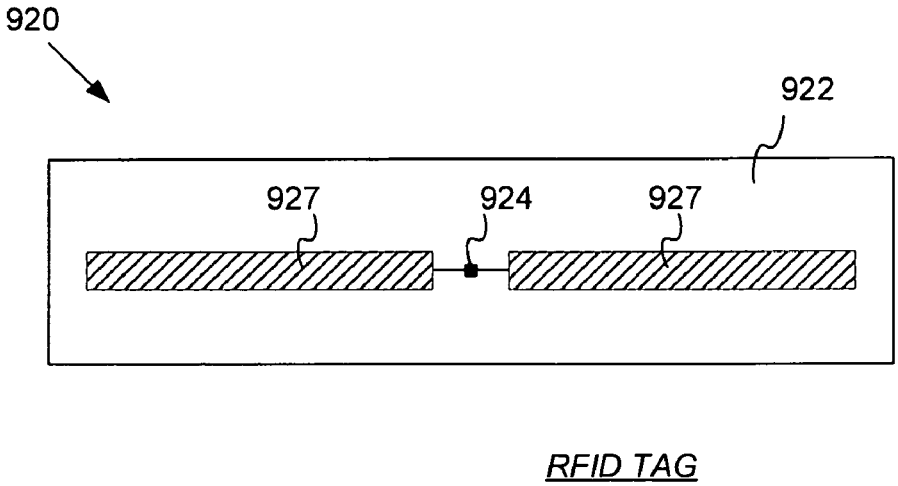
FIG. 9 is a diagram showing components of a passive RFID tag, such as the one shown in FIG. 8.

FIG. 9 shows a bias circuit 610 in a core circuit 601 where the bias circuit optionally includes an amplifier circuit 630 to drive the PMOS transistors 611, 612. Amplifier circuits are common in the art, any number of which may be used as the amplifier circuit 630. The amplifier circuit 630 may additionally control the ratio between the currents through the transistors 314, 319, 326, by adjusting the magnitudes of the respective currents.

In the core circuit 601, the gates of the transistors 314, 319, 326 are coupled together to the drain of the transistor 611. Thus, the output voltage $V_{NGATE}$ may be accessible at a node 617 in the current path that includes the positive input of the amplifier circuit 630 and the resistive component 316. $V_{PGATE}$ may be accessed at the output of the amplifier in the bias circuit.

Figure 7:
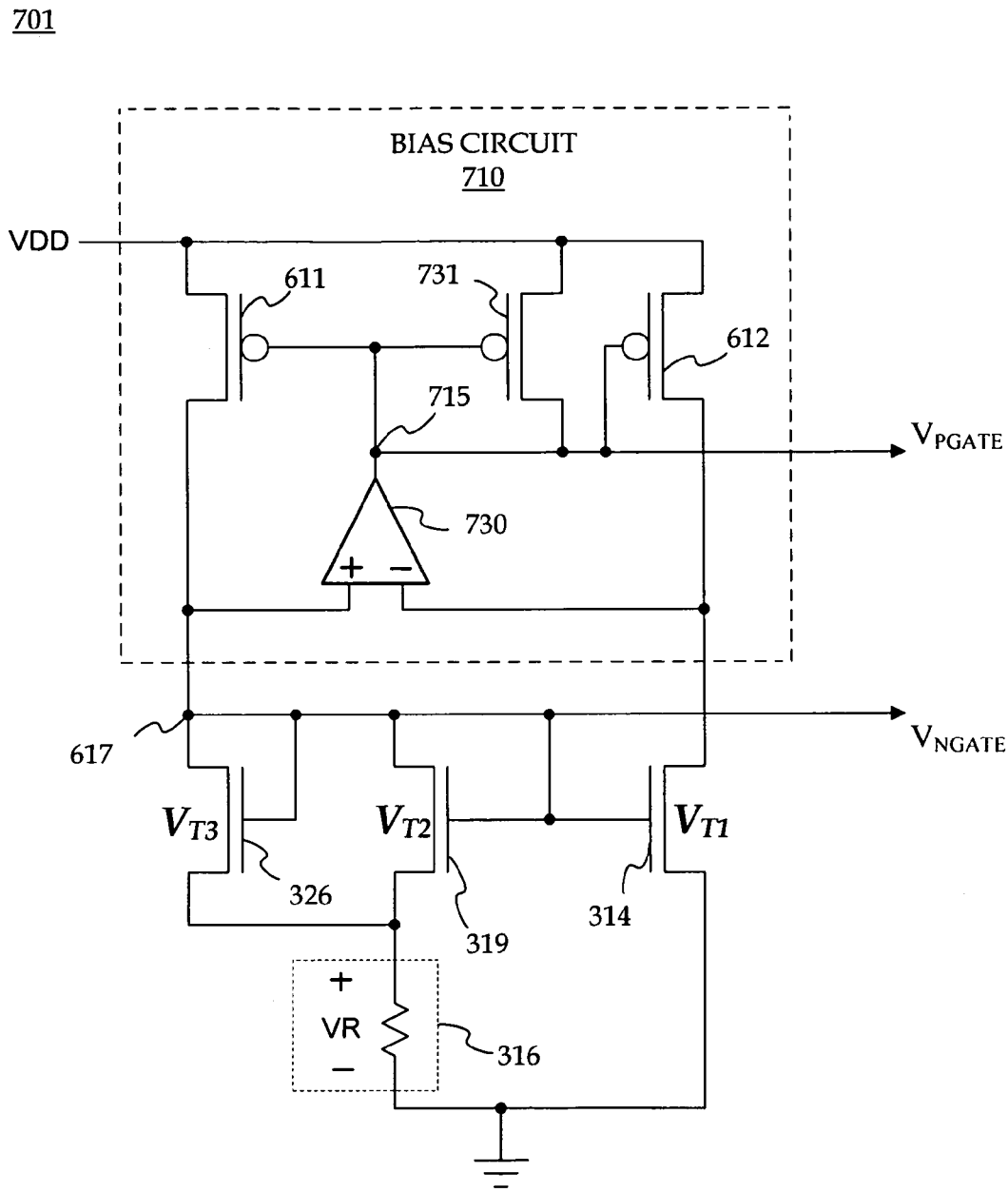
FIG. 7 is a schematic diagram of another core circuit according to a further embodiment coupled to a bias circuit having a transconductance amplifier.

FIG. 7 shows, as another embodiment, a core circuit 701 having a bias circuit 77 that includes a transconductance amplifier 730. The transconductance amplifier 730 may be implemented in any way. One of the ways is shown with the transconductance amplifier 730 receiving voltage inputs from drain nodes of the transistors 611, 612. The transconductance amplifier 730 instead generates an output current through a node 713 to drive the transistors 611, 612 at a node 713. The output current may be converted to an output voltage $V_{PGATE}$ at node 713 by a third PMOS transistor 731 whose gate and drain are coupled to the node 713 and receives the output current at node 713.

Figure 8:
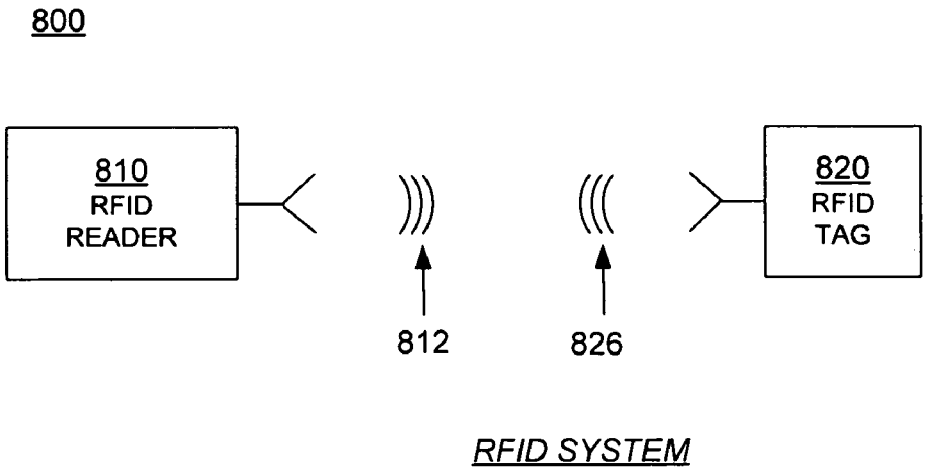
FIG. 8 is a block diagram of an RFID system having an RFID tag that includes a reference current generator circuit according to embodiments.

FIG. 8 is a diagram of components of a typical RFID system 800, incorporating aspects of the invention. An RFID reader 810 transmits an interrogating Radio Frequency (RF) wave 812. RFID tag 820 in the vicinity of RFID reader 810 may sense interrogating RF wave 812, and generate wave 826 in response. RFID reader 810 senses and interprets wave 826.

Reader 810 and tag 820 exchange data via wave 812 and wave 826. In a session of such an exchange, each encodes, modulates, and transmits data to the other, and each receives, demodulates, and decodes data from the other. The data is modulated onto, and decoded from, RF waveforms.

Tag 820 can be a passive tag or an active tag, i.e. having its own power source. Where tag 820 is a passive tag, it is powered from wave 812. Embodiment of the invention may be utilized in the tag 820 to power various components of the tag 820 with bias currents that are substantially independent of temperature variations. Less power is used, and sensitivity improved by using temperature regulated bias currents to control the amount of power used in the tag 820.

FIG. 9 is a diagram of an RFID tag 920, which can be the same as tag 820 of FIG. 8. Tag 920 is implemented as a passive tag, meaning it does not have its own power source. It will be appreciated, however, that many of the embodiments previously described applies also to active tags.

Tag 920 is formed on a substantially planar inlay 922, which can be made in many ways known in the art. Tag 920 includes an electrical circuit, which is preferably implemented in an integrated circuit (IC) 924. IC 924 is arranged on inlay 922.

Tag 920 also includes an antenna for exchanging wireless signals with its environment. The antenna is usually flat and attached to inlay 922. IC 924 is electrically coupled to the antenna via suitable antenna ports (not shown in FIG. 9).

The antenna may be made in a number of ways, as is well known in the art. In the example of FIG. 9, the antenna is made from two distinct antenna segments 927, which are shown here forming a dipole. Many other embodiments are possible, using any number of antenna segments.

In some embodiments, an antenna can be made with even a single segment. Different places of the segment can be coupled to one or more of the antenna ports of IC 924. For example, the antenna can form a single loop, with its ends coupled to the ports. When the single segment has more complex shapes, it should be remembered that at, the frequencies of RFID wireless communication, even a single segment could behave like multiple segments.

In operation, a signal is received by the antenna, and communicated to IC 924. IC 924 both harvests power, and responds if appropriate, based on the incoming signal and its internal state. In order to respond by replying, IC 924 modulates the reflectance of the antenna, which generates the backscatter from a wave transmitted by the reader. Coupling together and uncoupling the antenna ports of IC 924 can modulate the reflectance, as can a variety of other means.

In the embodiment of FIG. 9, antenna segments 927 are separate from IC 924. In other embodiments, antenna segments may alternately be formed on IC 924, and so on.

The components of the RFID system of FIG. 8 may communicate with each other in any number of modes. One such mode is called full duplex. Another such mode is called half-duplex, and is described below.

Figure 10:
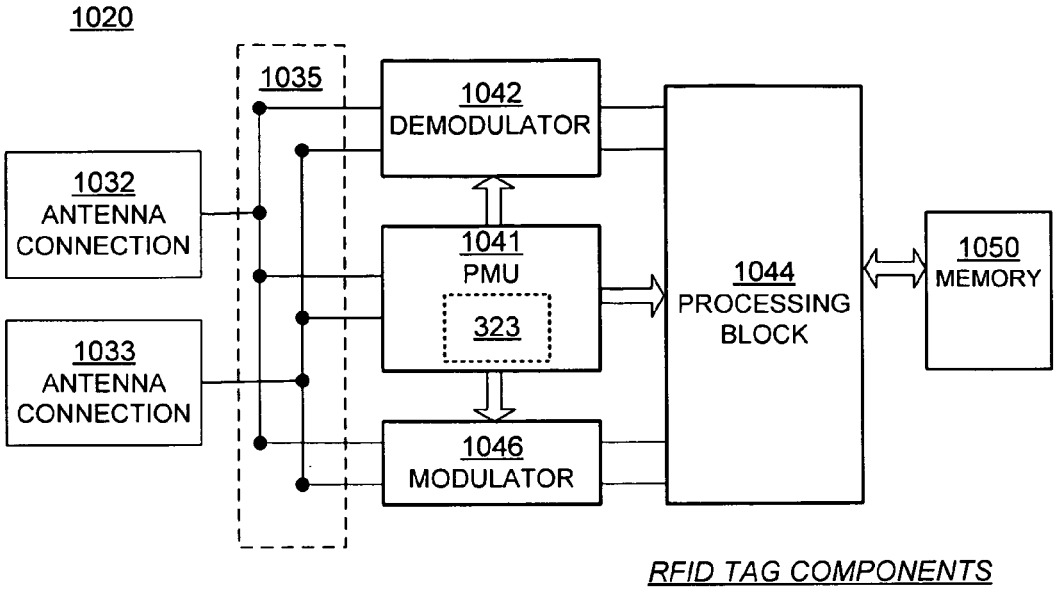
FIG. 10 is a block diagram of an implementation of an electrical circuit of a passive RFID tag, such as the one shown in FIG. 9.

FIG. 10 is a block diagram of an electrical circuit 1020. Circuit 1020 may be formed in an IC of an RFID tag, such as IC 924 of FIG. 9. Circuit 1020 has a number of main components that are described in this document. Circuit 1020 may have a number of additional components from what is shown and described, or different components, depending on the exact implementation.

Circuit 1020 includes at least two antenna connections 1032, 1033, which are suitable for coupling to one or more antenna segments (not shown in FIG. 10). Antenna connections 1032, 1033 may be made in any suitable way, such as pads and so on. In a number of embodiments more than two antenna connections are used, especially in embodiments where more antenna segments are used.

Circuit 1020 includes a section 1035. Section 1035 may be implemented as shown, for example as a group of nodes for proper routing of signals. In some embodiments, section 1035 may be implemented otherwise, for example to include a receive/transmit switch that can route a signal, and so on.

Circuit 1020 also includes a Power Management Unit (PMU) 1041. PMU 1041 may be implemented in any way known in the art, for harvesting raw RF power received via antenna connections 1032, 1033. In some embodiments, PMU 1041 includes at least one rectifier, and so on.

In operation, an RF wave received via antenna connections 1032, 1033 is received by PMU 1041, which in turn generates power for components of circuit 1020. This is true for either or both R→T and T→R sessions, whether or not the received RF wave is modulated.

The PMU 1041 may include the reference current generator circuit 323 of FIG. 3 or any other reference current generator circuit described in previous embodiments, or modified by a person skilled in the art, to generate reference currents substantially independent of temperature variations. The reference current generator circuit 323 may supply current to power the PMU 1041.

Circuit 1020 additionally includes a demodulator 1042. Demodulator 1042 demodulates an RF signal received via antenna connections 1032, 1033. Demodulator 1042 may be implemented in any way known in the art, for example including an attenuator stage, amplifier stage, and so on.

Circuit 1020 further includes a processing block 1044. Processing block 1044 receives the demodulated signal from demodulator 1042, and may perform operations. In addition, it may generate an output signal for transmission.

Processing block 1044 may be implemented in any way known in the art. For example, processing block 1044 may include a number of components, such as a processor, memory, a decoder, an encoder, and so on.

Circuit 1020 additionally includes a modulator 1046. Modulator 1046 modulates an output signal generated by processing block 1044. The modulated signal is transmitted by driving antenna connections 1032, 1033, and therefore driving the load presented by the coupled antenna segment or segments. Modulator 1046 may be implemented in any way known in the art, for example including a driver stage, amplifier stage, and so on.

In one embodiment, demodulator 1042 and modulator 1046 may be combined in a single transceiver circuit. In another embodiment, modulator 1046 may include a backscatter transmitter or an active transmitter. In yet other embodiments, demodulator 1042 and modulator 1046 are part of processing block 1044.

Circuit 1020 additionally includes a memory 1050. Memory 1050 is preferably implemented as a Non-Volatile Memory (NVM), which means that data is retained, even when circuit 1020 does not have power, as is frequently the case for a passive RFID tag.

It will be recognized at this juncture that the components of circuit 1020 can also be those of a circuit of an RFID reader according to the invention, without needing PMU 1041. Indeed, an RFID reader can typically be powered differently, such as from a wall outlet, a battery, and so on. Additionally, when circuit 1020 is configured as a reader, processing block 1044 may have additional Inputs/Outputs (I/O) to a terminal, network, or other such devices or connections.

Figure 11:
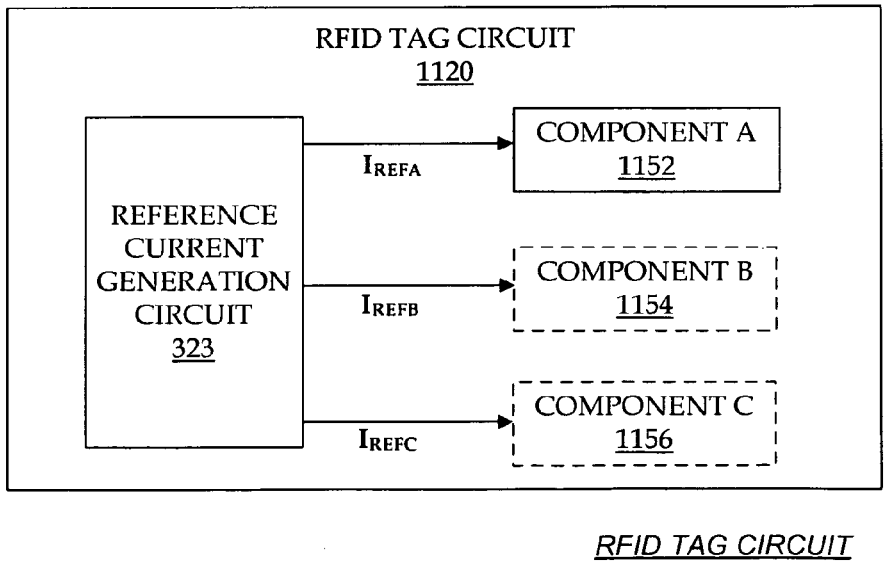
FIG. 11 is a block diagram of a tag circuit that includes the reference current generation block of FIG. 3 according to an embodiment.

FIG. 11 is a block diagram of a tag circuit 1120 that includes the reference current generator circuit 323 of FIG. 3, according to an embodiment. The reference current generator circuit 323 may be implemented in any way previously described to generate a reference current $I_{REFA}$ supplied to power a component A 1152 in a tag circuit. The component A 1152 may be the PMU 1041, the demodulator 1042, other components that may be in the processing block 1044, such as an oscillator, a persistent bit circuit or an analog random number generator, or any other component shown or not shown in FIG. 10, and contained in the tag circuits 1020, 1120.

Additionally, more than one reference current, $I_{REFB}$, and $I_{REFc}$ may be generated by the reference current generation circuit 323 to optionally supply currents simultaneously to more than one component, such as to another component B 1154 and a further component C 1156. Component B 1154 and component C 1156 may be any component in the tag circuit that require power or biasing for operation, such as the tag components previously described.

Embodiments of the invention also include methods. Some are methods of operation of a reference current generator circuit, a reference current generator system, an RFID tag or RFID tag system. Others are methods for controlling such reference generator circuits or RFID tag system.

These methods can be implemented in any number of ways, including the structures described in this document. Methods are now described more particularly according to embodiments.

Figure 12:
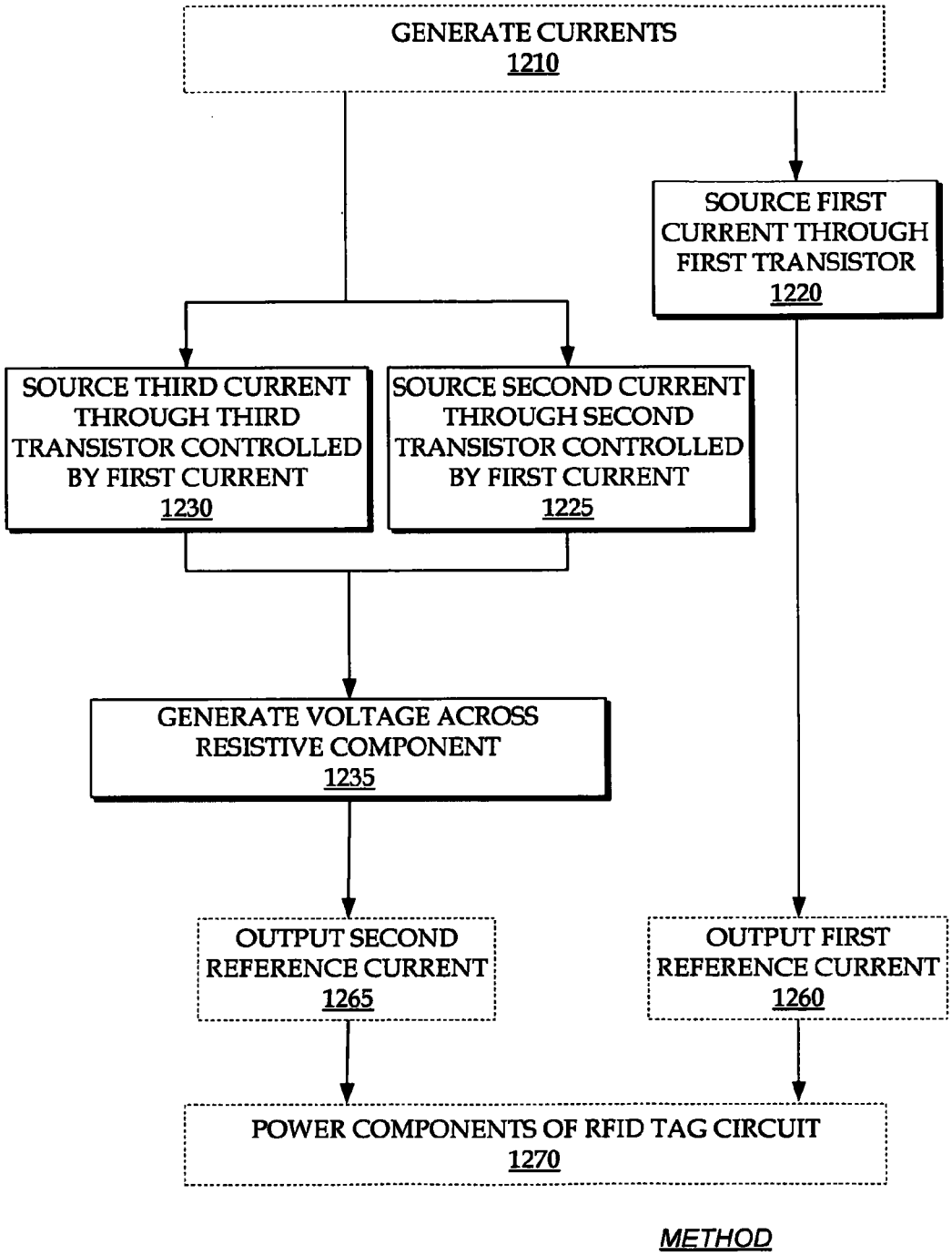
FIG. 12 is a flow diagram illustrating a method for generating reference currents substantially independent of temperature according to embodiments.

FIG. 12 is a flow diagram illustrating a method for generating reference currents substantially independent of temperature according to embodiments. According to an operation step 1210, one or more currents may be generated to source a first current, as shown in a next operation step 1220, through the first transistor 310 of FIG. 3 in a first current path. The current provided in the step 1210 is optional, and can be implemented a number of ways, such as the bias circuit embodiments previously described. The bias circuit embodiments may optionally receive an initial current from a start-up circuit (not shown) that initializes the generation of the one or more currents in step 1210.

According to a next operation step at 1225, a second current is sourced through the second transistor 319 in a second current path. The second current may be controlled by the first current, for example at the step 1210, such that the second current is substantially the same as the first current.

According to another operation step at 1230, a third current may be sourced through the third transistor 326. The third current being sourced through the third transistor 326 is also controlled by the first current through the first transistor 310 in a manner such that the combined gate-to-source voltage of the second and third transistors 319, 326 is different relative to the gate-to-source voltage of the first transistor 310.

According to another operation step at 1235, a voltage is generated across the resistive component 316, thereby driving a current through the resistive component 316. The voltage drop across the resistive component 316 may be generated a number of ways, such as by generating the voltage differential between the gate-to-source voltages of the combined second and third transistors 319, 326 relative to the first transistor 310.

Additionally, the third transistor 326 conducts the third current at a threshold voltage that is different from the threshold voltage of the second transistor 319. For example, if assuming the drain current of the second transistor 319 is dominated by the threshold voltage and, therefore increases with temperature, the third transistor 326 may be biased at a lower threshold voltage that sufficiently sources the drain current at a negative temperature coefficient. The drain current through the third transistor 326 decreasing with temperature thus counteracts the drain current through the second transistor 319 increasing with temperature. Therefore, the current through the resistive component 316, which may be the sum of currents through the second and third transistors 319, 326, is substantially independent of temperature variations.

According to an optional step at 1260 the first current sourced through the first transistor 310 may be mirrored to output a first reference current in any way known in the art. Additional reference currents may be generated, by mirroring multiple reference currents from the first current.

Alternatively, according to an optional step at 1265, additional reference currents may be generated by mirroring the current through the resistive component 316 to output a second reference current. The second reference current may also be mirrored to generate multiple mirror currents.

According to an optional operation step at 1270, multiple reference currents may be provided to power components of an RFID tag circuit. For example, one of the reference currents may be utilized to power the PMU 1041 of FIG. 10. Multiple reference currents may be utilized to supply a bias current to multiple tag circuit components simultaneously, such as to the demodulator, the random number generator, the persistent bit circuit, the oscillator, and other tag components, as previously described.

In this description, numerous details have been set forth in order to provide a thorough understanding. In other instances, well-known features have not been described in detail in order to not obscure unnecessarily the description.

A person skilled in the art will be able to practice the present invention in view of this description, which is to be taken as a whole. The specific embodiments as disclosed and illustrated herein are not to be considered in a limiting sense. Indeed, it should be readily apparent to those skilled in the art that what is described herein may be modified in numerous ways. Such ways can include equivalents to what is described herein.

The following claims define certain combinations and subcombinations of elements, features, steps, and/or functions, which are regarded as novel and non-obvious. Additional claims for other combinations and subcombinations may be presented in this or a related document.

What is claimed is:

1. A core circuit for a reference current generation circuit, comprising:

a first transistor in a first current path, having a drain coupled to a first node of a bias circuit for sourcing a first current to the core circuit;

a second transistor in a second current path, having a gate coupled to the gate of the first transistor, a drain coupled to a second node of the bias circuit, and configured to source a second current through the second node;

a third transistor, having a gate coupled to the gates of the first and second transistors, a drain coupled to the drain of the second transistor and the bias circuit through the second node, wherein the gates of the first, second, and third transistors are also coupled to the second node, and the third transistor is configured to source a third current through the second node, the third transistor having a threshold voltage that is different relative to a threshold voltage of the second transistor; and a resistive component coupled to conduct a combination of the second and third currents, wherein the combination of the second and third currents and the first currents are substantially similar.

2. The core circuit of claim 1, in which the first node is coupled to an inverting input of an amplifier in the bias circuit; and the second node is coupled to a non-inverting input of the amplifier in the bias circuit.

3. The core circuit of claim 1, in which the threshold voltage of the third transistor is less than the threshold voltage of the second transistor.

4. The core circuit of claim 1, in which the sources of the second and third transistors are coupled together and coupled to the resistive component.

5. The core circuit of claim 1, in which a voltage at the first node maintains a substantially constant voltage that is substantially independent of temperature variations.

6. The core circuit of claim 1, in which a resistance of the resistive component is substantially equal to one million ohms.

7. The core circuit of claim 1, in which the first and second transistors have substantially similar transistor characteristics.

8. The core circuit of claim 1, in which a combined threshold voltage of the second and third transistors is less than the threshold voltage of the first transistor.

9. The core circuit of claim 1, in which the second transistor has a first temperature coefficient; and the third transistor has a second temperature coefficient that substantially compensates for the first temperature coefficient.

10. The core circuit of claim 9, in which the second current through the second transistor increases with temperature; and the third current through the third transistor decreases with temperature to compensate for the second current increasing with temperature.

11. The core circuit of claim 9, in which the second and third transistors of the second current path comprises a second temperature coefficient that counteracts the effect of the first temperature coefficient of the first current path within a substantial portion of the temperature range, the third transistor being in the second current path.

12. A core circuit for a reference current generation circuit, comprising:

a first transistor in a first current path, having a drain coupled to a first node of a bias circuit for sourcing the first current to the core circuit, wherein a first node is coupled to an inverting input of a transconductance amplifier of the bias circuit;

a second transistor in a second current path, having a gate coupled to the gate of the first transistor, a drain coupled to a second node of the bias circuit, and configured to source a second current through the second node, wherein the second node is coupled to a non-inverting input of the transconductance amplifier of the bias circuit;

a third transistor, having a gate coupled to the gates of the first and second transistors, a drain coupled to the drain of the second transistor and the bias circuit through the second node, wherein the gates of the first, second, and third transistors are also coupled to the second node, and the third transistor is configured to source a third current through the second node, the third transistor having a threshold voltage that is different relative to a threshold voltage of the second transistor; and a resistive component coupled to conduct a combination of the second and third currents, wherein the combination of the second and third currents and the first currents are substantially similar.

13. A method of generating a reference current comprising:

sourcing a first current through a first transistor in a first current path through a first node coupled to a drain of the first transistor;

sourcing a second current through a second transistor in a second current path controlled by the first current, wherein a gate of the second transistor is coupled to a gate of the first transistor and a drain of the second transistor is coupled to a second node;

sourcing a third current through a third transistor in the second current path controlled by the first current, the third transistor conducting current at a different threshold voltage from a threshold voltage of the second transistor, wherein a drain of the third transistor is coupled to the drain of the second transistor and gates of the first, second, and third transistors are also coupled to the second node; and generating a voltage across a resistive component in the second current path that is substantially the same as the voltage differential between the voltages across the first and second transistors.

14. The method of claim 13, in which the second current increases with increasing temperature; and the third current decreases with increasing temperature.

15. The method of claim 13, in which a sum of the second and third currents through the first and second transistors has a temperature coefficient that substantially counteracts an effect of a temperature coefficient of the first current in the first current path.

16. The method of claim 13, in which the first node is coupled to an inverting input of an amplifier in the bias circuit; and the second node is coupled to a non-inverting input of the amplifier in the bias circuit.

17. The method of claim 13, in which the first node is coupled to an inverting input of a transconductance amplifier in the bias circuit; and the second node is coupled to a non-inverting input of the transconductance amplifier in the bias circuit.

* * * * *

UNITED STATES PATENT AND TRADEMARK OFFICE

CERTIFICATE OF CORRECTION

PATENT NO. : 7,969,236 B1
APPLICATION NO. : 12/471362
DATED : June 28, 2011
INVENTOR(S) : Hyde et al.

It is certified that error appears in the above-identified patent and that said Letters Patent is hereby corrected as shown below:

(1) Please Delete "IREFc" on column 10, line 9 and insert -- IREFC --, therefor.

Signed and Sealed this
Eleventh Day of October, 2011

David J. Kappos

David J. Kappos
*Director of the United States Patent and Trademark Office*